US008963779B2

(12) United States Patent
Huang et al.

(10) Patent No.: US 8,963,779 B2
(45) Date of Patent: Feb. 24, 2015

(54) SILICON-BASED SUSPENDING ANTENNA WITH PHOTONIC BANDGAP STRUCTURE

(75) Inventors: I-Yu Huang, Kaohsiung (TW); Chian-Hao Sun, Kaohsiung (TW); Kuo-Yi Hsu, Taichung (TW)

(73) Assignee: Industrial Technology Research Institute, Hsinchu (TW)

( * ) Notice: Subject to any disclaimer, the term of this patent is extended or adjusted under 35 U.S.C. 154(b) by 906 days.

(21) Appl. No.: 13/034,025

(22) Filed: Feb. 24, 2011

(65) Prior Publication Data

US 2012/0112982 A1 May 10, 2012

(30) Foreign Application Priority Data

Nov. 8, 2010 (TW) ..... 099138398 A

(51) Int. Cl.
*H01Q 1/38* (2006.01)
*H01Q 5/00* (2006.01)
*H01Q 15/00* (2006.01)

(52) U.S. Cl.
CPC ..... *H01Q 1/38* (2013.01); *H01Q 5/0017* (2013.01); *H01Q 5/0055* (2013.01); *H01Q 15/006* (2013.01)
USPC ..... 343/700 MS; 343/767; 343/846

(58) Field of Classification Search
CPC ..... H01Q 13/10; H01Q 1/38; H01Q 9/0421
USPC ..... 343/700 MS, 767, 846
See application file for complete search history.

(56) References Cited

U.S. PATENT DOCUMENTS 6,369,771 B1 * 4/2002 Chiang et al. ..... 343/795
6,542,123 B1 4/2003 Chen
6,670,921 B2 12/2003 Sievenpiper et al.
6,742,241 B1 * 6/2004 Sasaki ..... 29/603.07

(Continued)

FOREIGN PATENT DOCUMENTS

TW 368735 9/1999
TW 1234901 6/2005

(Continued)

OTHER PUBLICATIONS

Yen-Liang et al., "Coplanar waveguide-fed folded inverted-F antenna for UMTS application," Microwave and Optical Technology Letters, Mar. 2002, vol. 32, No. 5, pp. 364-366.

(Continued)

*Primary Examiner* — Dameon E Levi
*Assistant Examiner* — Collin Dawkins
(74) *Attorney, Agent, or Firm* — WPAT, P.C.; Anthony King; Kay Yang

(57) ABSTRACT

The disclosure provides a silicon-based suspending antenna with photonic bandgap structure, which includes a silicon substrate, an electrode layer, a spacing part and an F-shaped structure. The silicon substrate has a first side surface and a second side surface oppositing to the first surface. The electrode layer has a flat part, a first base and at least one second base, in which one side of the flat part has a notch, the first base, the second base and the notch are separately disposed on the second side surface and essentially parallel to the longitudinal edge of the second side surface, the first base has a main body and an extension, and the extension extends from the main body and into the notch. The F-shaped structure has a longitudinal part disposed on the spacing part and is parallel to the second side surface.

26 Claims, 12 Drawing Sheets

(56) References Cited

U.S. PATENT DOCUMENTS

| | | | | |
|---|---|---|---|---|
| 7,027,838 | B2 * | 4/2006 | Zhou et al. | 455/562.1 |
| 7,034,769 | B2 | 4/2006 | Surducan et al. | |
| 7,095,382 | B2 | 8/2006 | Surducan et al. | |
| 7,106,259 | B2 | 9/2006 | Tseng et al. | |
| 7,541,980 | B2 | 6/2009 | Shih | |
| 2002/0192886 | A1 * | 12/2002 | Inoue | 438/197 |
| 2003/0011518 | A1 * | 1/2003 | Sievenpiper et al. | 343/700 MS |
| 2004/0150567 | A1 * | 8/2004 | Yuanzhu | 343/700 MS |
| 2005/0110696 | A1 | 5/2005 | Surducan et al. | |
| 2005/0110698 | A1 | 5/2005 | Surducan et al. | |
| 2006/0092079 | A1 | 5/2006 | de Rochemont | |
| 2006/0208956 | A1 | 9/2006 | Surducan et al. | |
| 2007/0290264 | A1 * | 12/2007 | Sugii et al. | 257/348 |
| 2009/0051611 | A1 * | 2/2009 | Shamblin et al. | 343/747 |
| 2009/0153427 | A1 * | 6/2009 | Rofougaran | 343/787 |
| 2009/0231225 | A1 * | 9/2009 | Choudhury et al. | 343/770 |
| 2009/0284440 | A1 * | 11/2009 | Weidmann et al. | 343/893 |
| 2010/0026590 | A1 * | 2/2010 | Chiang et al. | 343/702 |
| 2011/0012697 | A1 | 1/2011 | Takemura et al. | |

FOREIGN PATENT DOCUMENTS

| | | |
|---|---|---|
| TW | 1250688 | 12/2005 |
| TW | 1274439 | 4/2006 |
| TW | 1293820 | 4/2006 |
| TW | 1292496 | 12/2006 |

OTHER PUBLICATIONS

Zhi Ning Chen et al., "Experimental Study on Radiation Performance of Probe-Fed Suspended Plate Antennas," IEEE Transactions on Antennas and Propagation, Aug. 2003, vol. 51, No. 8, pp. 1964-1971.

Erick Ojefors et al., "Micromachined Inverted F Antenna for Integration on Low Resistivity Silicon Substrates," IEEE Microwave and Wireless Components Letters, Oct. 2005, vol. 15, No. 10, pp. 627-629.

English abstract of TW 368735.

Zhengwei Du et al., "A Compact Planar Inverted-F Antenna With a PBG-Type Ground Plane for Mobile Communications," IEEE Transactions on Vehicular Technology, May 2003, vol. 52, No. 3, pp. 483-489.

Sangil Kwak et al., "Design of Multilayer PIFA based on an EBG structure for SAR reduction in mobile Applications," IEEE Microwave Conference 2009 APMC, Dec. 2009, pp. 645-648.

Jian-Kang Xiao et al., "A New PBG Suspended Patch Antenna, 8th International Symposium on Antennas," Propagation and EM Theory, ISAPE 2008, Nov. 2008, pp. 229-232.

Xue Ni Low et al., "Broadband Suspended Plate Antenna for WiFi-WiMAX Applications," 6th International Conference on Information, Communications & Signal Processing, 2007, Dec. 2007, pp. 1-5.

English abstracts of TW I274439, I234901, I292496, I250688, and I293820.

Office Action issued on Nov. 21, 2013 by SIPO for the corresponding China Patent Application No. 201010617482.7 which cites US2006/0092079A1 and US2011/0012697A1.

Notice of Allowance issued on May 21, 2014 by TIPO for the corresponding TW Patent Application No. 099138398.

Elli et al., IEEE MTT-S International, "MM-Wave Tapered Slot Antennas on Mi cromachined Photonic Bandgap Dielectrics", vol. 2, pp. 1157-1160(1996).

Cho et al., IEEE Antennas and Wireless Propagation Letters, "A Wideband Internal Antenna With Dual Monopole Radiation Elements", vol. 4, pp. 381-384(2005).

Haridas et al., Antennas, Propagation & EM Theory, 2006. ISAPE '06. 7th International Symposium on, "Simulating Photonic Bandgap Antennas on Silicon Substrate", pp. 26-29(2006).

* cited by examiner

SILICON-BASED SUSPENDING ANTENNA WITH PHOTONIC BANDGAP STRUCTURE

BACKGROUND

1. Technical Field

The disclosure relates to an antenna and method for making the same, and more particularly to a silicon-based suspending antenna with photonic bandgap structure and method for making the same.

2. Description of the Related Art

In ultra-wideband (UWB) technology, bandwidth between 3.1 GHz to 10.6 GHz is often applied to imaging system, automotive radar system, communications and measurement system, as a wireless transmission multimedia interface of short range and high speed, to form an important technique of seamless communication. In recent years, wireless personal network (WPAN) systems have been defined in UWB, mainly for digital data transmission within a range of 10 meters. In addition, UWB has a high bandwidth and high transmission rate (up to a maximum of 500 Mbps), as well as low power consumption, high security, high transmission speed, low interference, precision positioning function, and low-cost chip structure, which makes it suitable for wireless personal networks and applications in digital consumer electronics products.

In the conventional technology such as making a planar antenna on a PCB substrate, the planar antenna has a narrow bandwidth and low radiation efficiency. In addition, due to the spurious wave effect and the surface effect of the microstrip antenna itself, when the conventional microstrip antenna in a communication system sends and receives signals, it can cause errors of the recognizing system data or affect the overall efficiency of data sending and receiving.

As to another conventional antenna, which is manufacturing on a silicon substrate (high dielectric constant), it has a narrow bandwidth and low radiation efficiency.

There is demand for a silicon-based suspending antenna with photonic bandgap structure and a method for making the same.

SUMMARY

The disclosure is directed to a silicon-based suspending antenna with photonic bandgap structure. The silicon-based suspending antenna includes: a silicon substrate, an electrode layer, a spacing part and an F-shaped structure. The silicon substrate has a first side surface and a second side surface oppositing to the first surface, the first side surface having a plurality of regular recesses, and the second side surface having a longitudinal edge. The electrode layer has a flat part, a first base and at least one second base. One side of the flat part has a notch, and the first base, the second base and the notch are separately disposed on the second side surface and essentially parallel to the longitudinal edge of the second side surface. The first base has a main body and an extension, and the extension extends from the main body and into the notch. The spacing part is disposed on the second base. The F-shaped structure has a longitudinal part disposed on the spacing part and is parallel to the second side surface.

Further, the disclosure is directed to a method for making a silicon-based suspending antenna with photonic bandgap structure. The method comprises the steps of: providing a silicon substrate having a first side surface and a second side surface oppositing to the first surface, wherein the second side surface has a longitudinal edge; defining a first pattern and a second pattern on the first side surface and the second side surface, respectively; forming an electrode layer on the second side surface according to the second pattern, wherein the electrode layer has a flat part, a first base and at least one second base, one side of the flat part having a notch, the first base, the second base and the notch being separately disposed on the second side surface and essentially parallel to the longitudinal edge of the second side surface, the first base having a main body and an extension, and the extension extending from the main body and into the notch; forming a spacing part on the second base; forming an F-shaped structure, wherein the F-shaped structure has a longitudinal part disposed on the spacing part and is parallel to the second side surface; and forming a plurality of regular recesses on the first side surface according to the first pattern.

BRIEF DESCRIPTION OF THE DRAWINGS

FIGS. 1A-9 show steps of making a silicon-based suspending antenna with photonic bandgap structure according to one embodiment of the disclosure, wherein FIG. 9 is a perspective view of the silicon-based suspending antenna according to one embodiment of the disclosure;

DETAILED DESCRIPTION

Figure 1A:
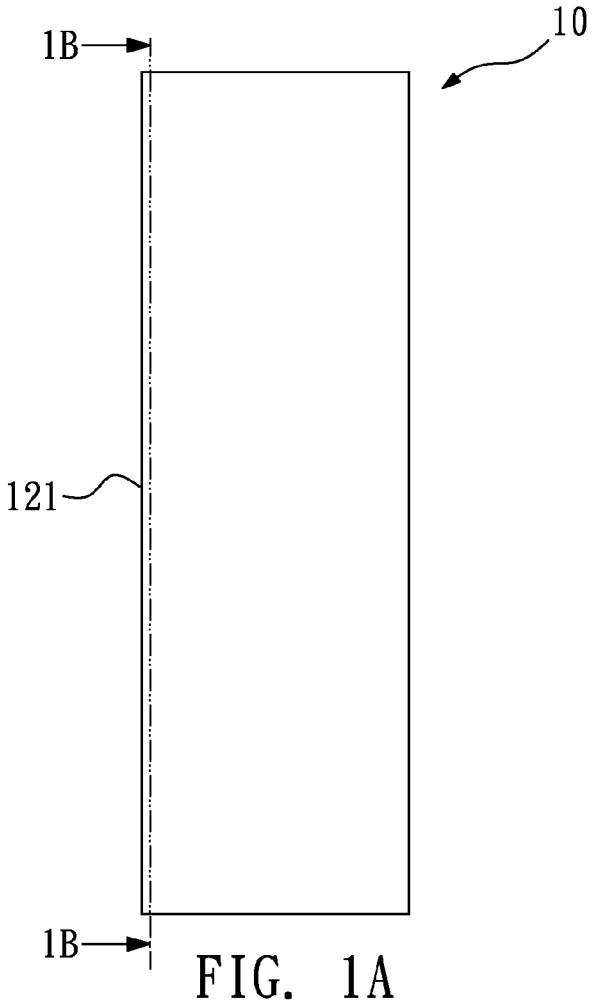
Figure 1B:
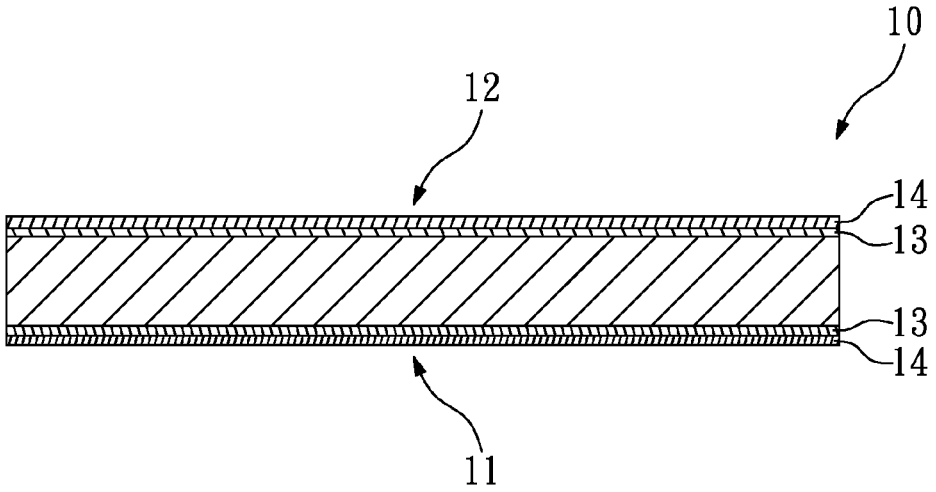

FIGS. 1A-9 show steps of making a silicon-based suspending antenna with photonic bandgap structure according to one embodiment of the disclosure. FIG. 1A is a top view of a silicon substrate according to one embodiment of the disclosure. FIG. 1B is a cross-sectional view along the cross-sectional line 1B-1B in FIG. 1A. As shown in FIGS. 1A and 1B, a silicon substrate 10 having a first side surface 11 and a second side surface 12 oppositing to the first surface 11 is provided, wherein the second side surface 12 has a longitudinal edge 121. In this embodiment, the first side surface 11 and the second side surface 12 have a silicon dioxide layer 13 and a nitride layer 14 from inside to outside, respectively.

Figure 2:
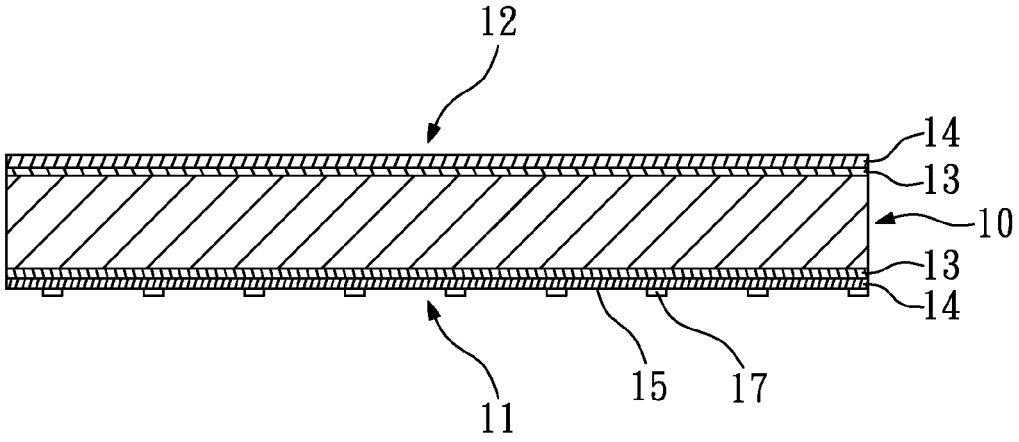
Figure 3:
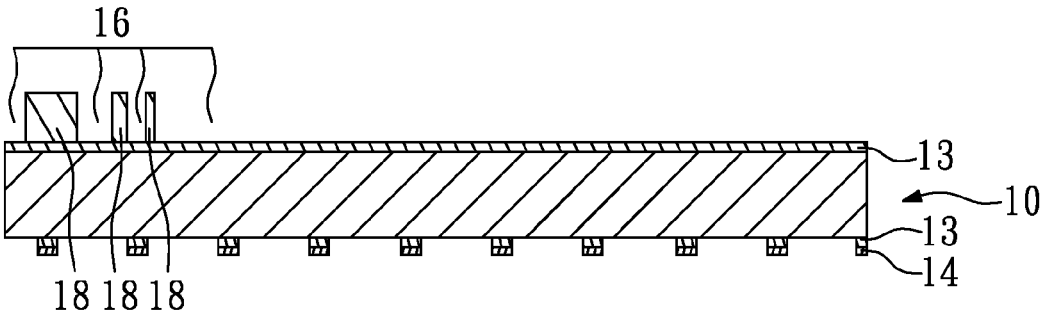

As shown in FIGS. 2 and 3, a first pattern 15 and a second pattern 16 are defined on the first side surface 11 and the second side surface 12, respectively. In this embodiment, a first photoresist mask 17 is used on the first side surface 11 to define the first pattern 15 (FIG. 2). Then, reactive ion etching (STS-RIE) system for dry-etching is used to remove nitride layer 14 on the second side surface 12, and parts of the silicon dioxide layer 13 and the nitride layer 14 are removed according to the first pattern 15. After that, a second photoresist mask 18 is used on the second side surface 12 to define the second pattern 16 (FIG. 2) and the first photoresist mask 17 is removed (FIG. 3).

Figure 4A:
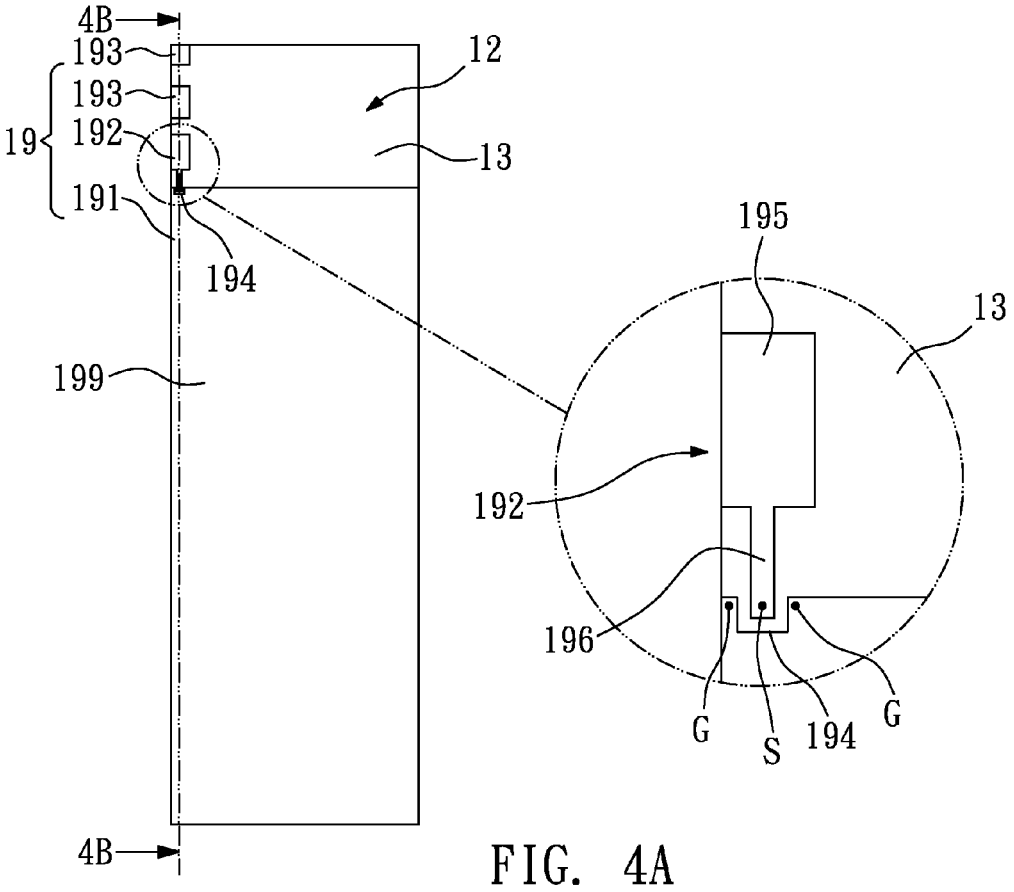
Figure 4B:
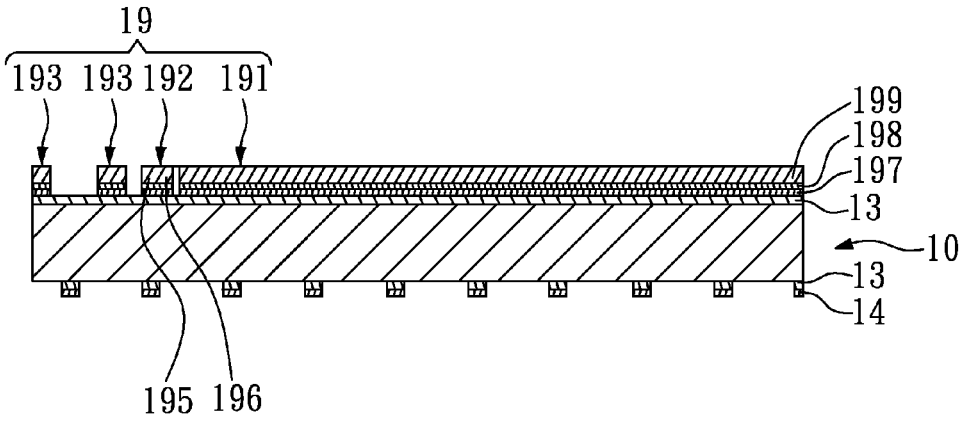

FIG. 4A is a top view of forming an electrode layer on a silicon substrate according to one embodiment of the disclosure. FIG. 4B is a cross-sectional view along the cross-sectional line 4B-4B in FIG. 4A.

As shown in FIGS. 3, 4 and 4B, an electrode layer 19 is formed on the second side surface 12 according to the second pattern 16. The electrode layer 19 has a flat part 191, a first base 192 and at least one second base 193. In this embodiment, the electrode layer 19 has two second bases 192. It is noted that the electrode layer 19 can have only one second base 192 at a corner of the silicon substrate 10, and the middle second base 192 is not formed. The flat part 191 has a notch 194 on one side. The first base 192, the second bases 193 and the notch 194 are separately disposed on the second side surface 12 and essentially parallel to the longitudinal edge 121 of the second side surface 12. The first base 192 has a main body 195 and an extension 196, and the extension 196 extends from the main body 195 and into the notch 194.

In this embodiment, the first base 192 and the second bases 193 are disposed on the second side surface 12 and lined along the longitudinal edge 121. However, the first base 192 and the second bases 193 and the longitudinal edge 121 can be separated by a space in such a way that the first base 192 and the second bases 193 are essentially parallel to the longitudinal edge 121.

The electrode layer 19 is preferably formed by lift-off process. In this embodiment, the process for making the electrode layer 19 includes the following steps: forming a plurality of conductive layers 197, 198, 199 (TaN layer, Ta layer, Cu layer) on the second side surface 12 according to the second pattern 16 (FIG. 3) by deposition; and removing the second photoresist mask 18 (FIG. 4B) to form the electrode layer 19. The deposited conductive layers 197, 198, 199 originally cover the second photoresist mask 18 and the silicon dioxide layer 13 exposed by the second pattern 16. The parts of the conductive layers 197, 198, 199 on the second photoresist mask 18 are removed together with the second photoresist mask 18 in the lift-off process to remove the second photoresist mask 18 (for example by using acetone), and the remaining parts of the conductive layers 197, 198, 199 form the electrode layer 19.

Figure 5:
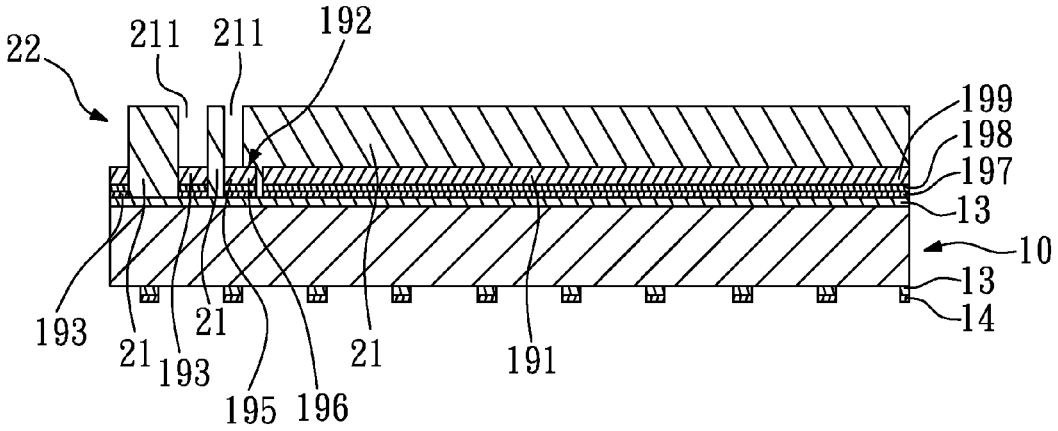
Figure 6:
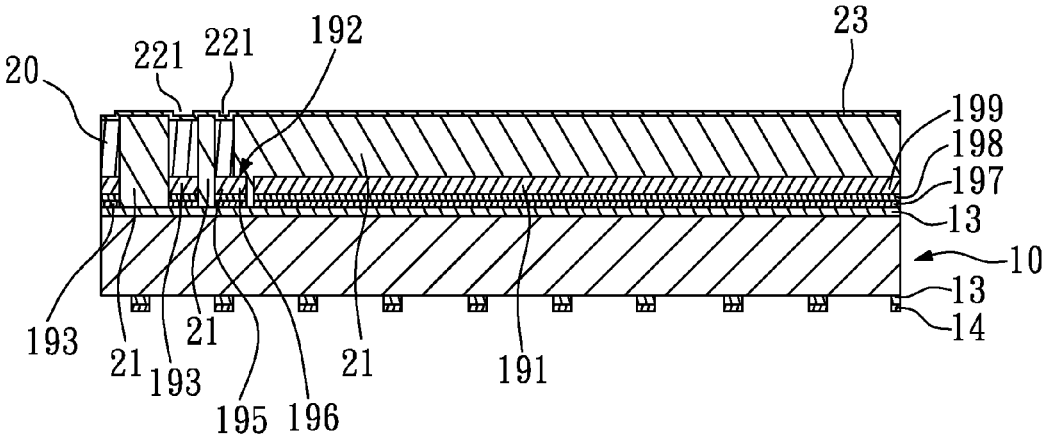

As shown in FIGS. 5 and 6, a spacing part 20 is formed on the main body 195 of the first base 192 and the second base 193. In this embodiment, forming the spacing part 20 includes the following steps: a third photoresist mask 21 is used on the second side surface 12 and the electrode layer 19 to define a third pattern 22, wherein the third photoresist mask 21 has two openings 211, the openings 211 are located at the relative position above the main body 195 and the second base 193; and the spacing part 20 is formed in the openings 211 by electroplating deposition, wherein the spacing part 20 does not fill up the openings 211.

Figure 7A:
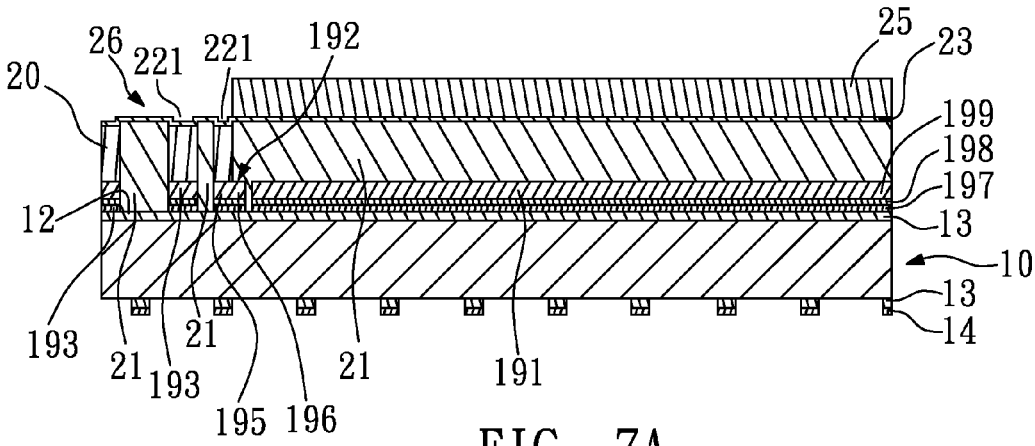
Figure 7B:
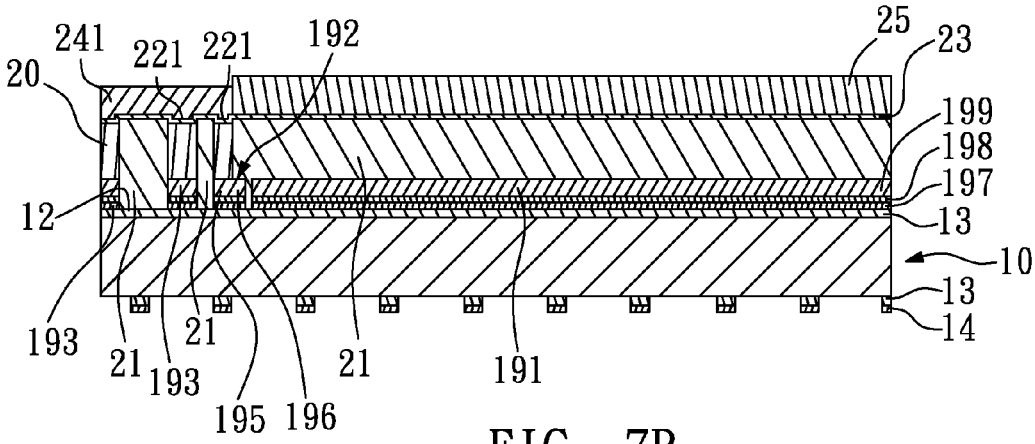
Figure 7C:
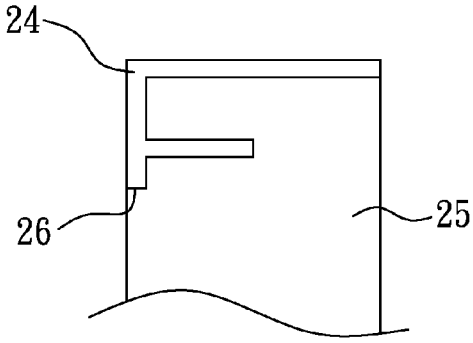

FIG. 7A is a cross-sectional view of a photoresist mask with F-shaped pattern on a seed layer according to one embodiment of the disclosure. FIG. 7B is a cross-sectional view after the F-shaped structure 24 is formed. FIG. 7C is a sectional top view of FIG. 7B. As shown in FIGS. 6 and 7A to 7C, the F-shaped structure 24 has a longitudinal part 241 disposed on the spacing parts 20, and the F-shaped structure 24 is substantially parallel to the second side surface 12. The electrode layer 19, the spacing part 20 and the F-shaped structure 24 form a wireless communication unit 30. In this embodiment, forming the F-shaped structure 24 includes the following steps: forming a seed layer 23 which covers the third photoresist mask 21 and the spacing parts 20, wherein the seed layer 23 has three notches 221 above the spacing parts 20; using a fourth photoresist mask 25 to define a fourth pattern 26 on the seed layer 23, wherein the fourth pattern 26 matches the pattern of the F-shaped structure 24; and forming the F-shaped structure 24 on the seed layer 23 according to the fourth pattern 26 by electroplating deposition.

Figure 8A:
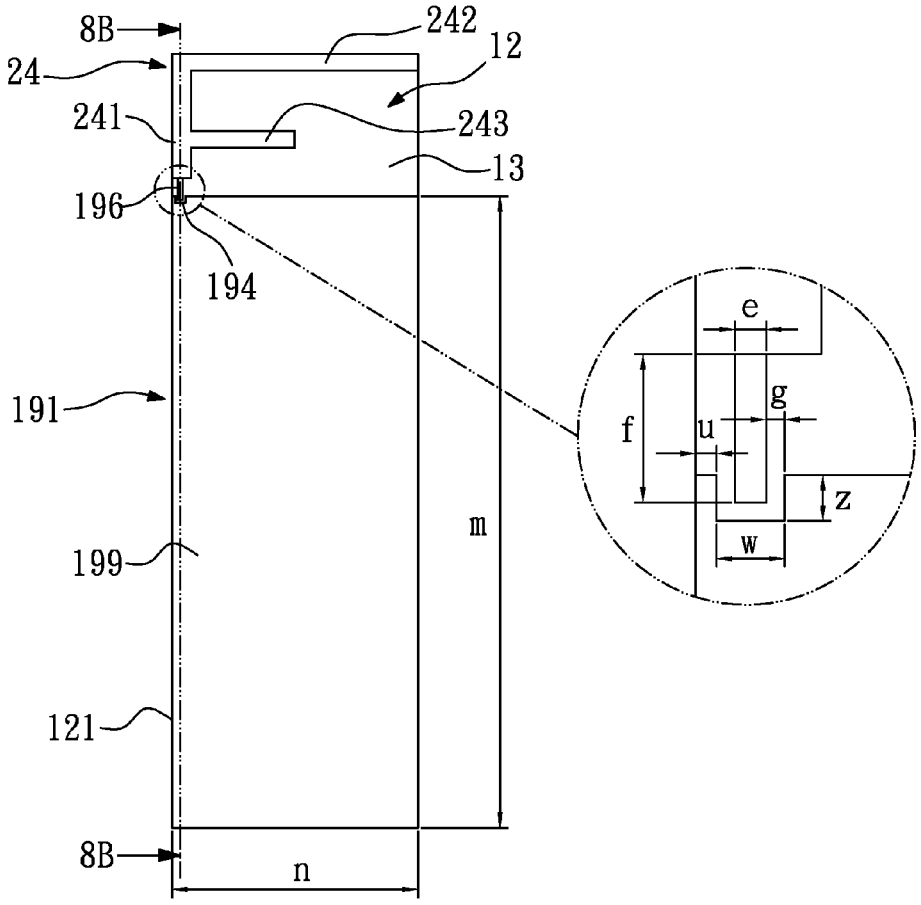
Figure 8B:
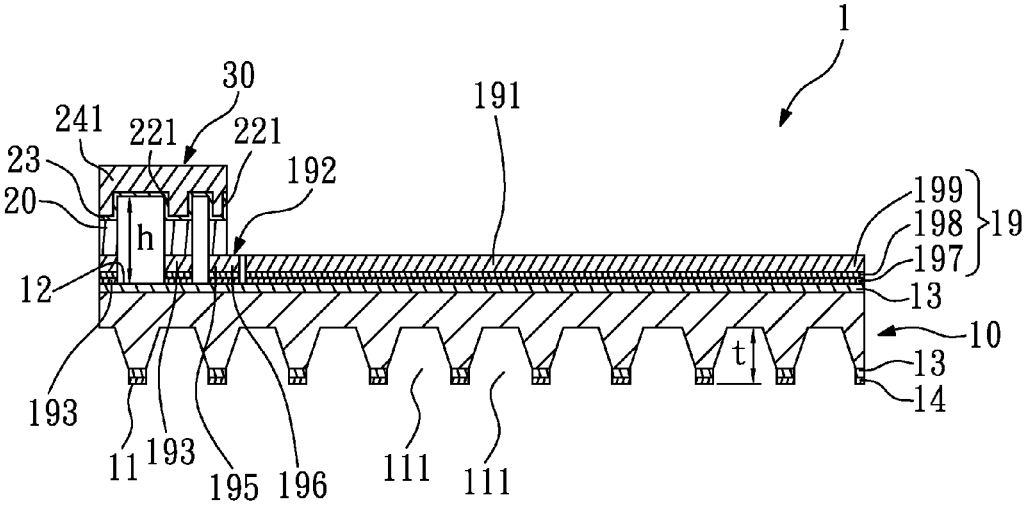
FIG. 8B is a cross-sectional view of the silicon-based suspending antenna according to one embodiment of the disclosure.
Figure 8C:
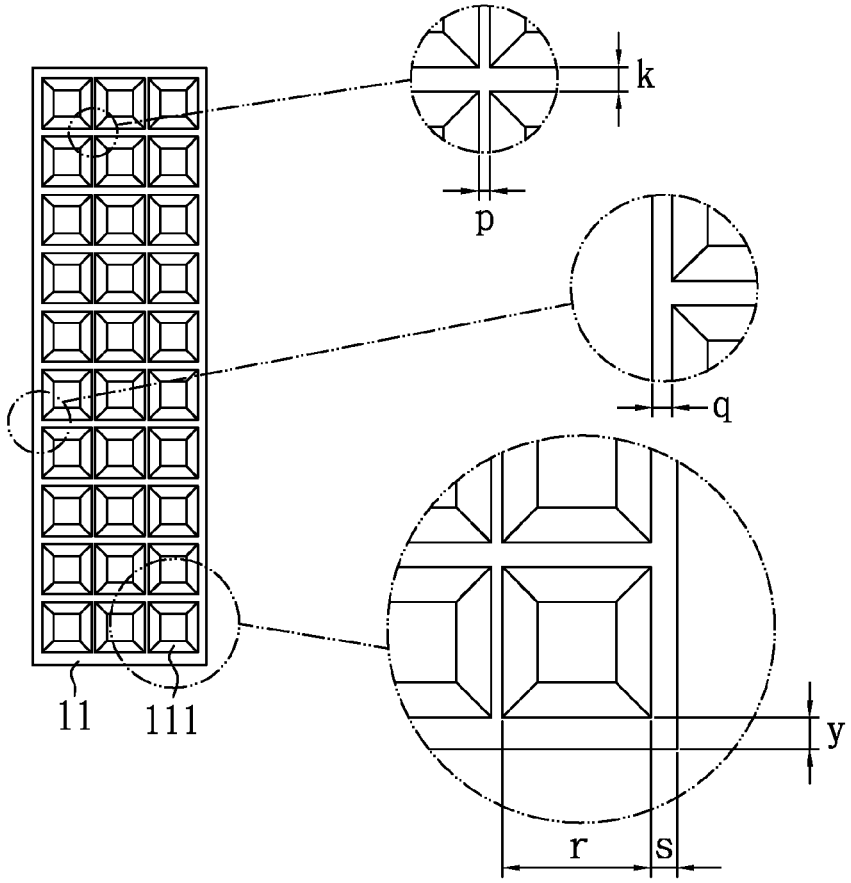
FIG. 8C is a top view of the silicon-based suspending antenna according to one embodiment of the disclosure.
Figure 8D:
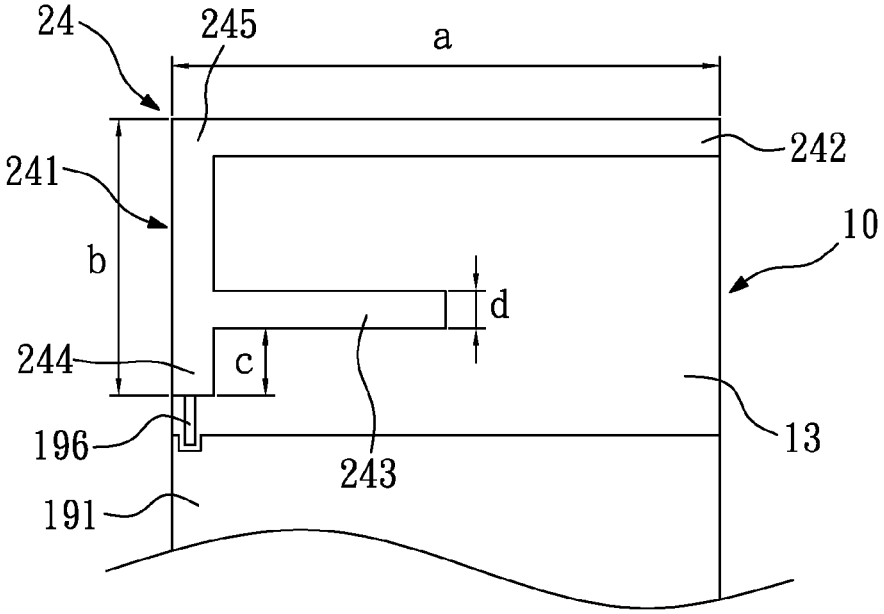
FIG. 8D is a partially-enlarged view of an F-shaped structure of the silicon-based suspending antenna according to one embodiment of the disclosure.
Figure 9:
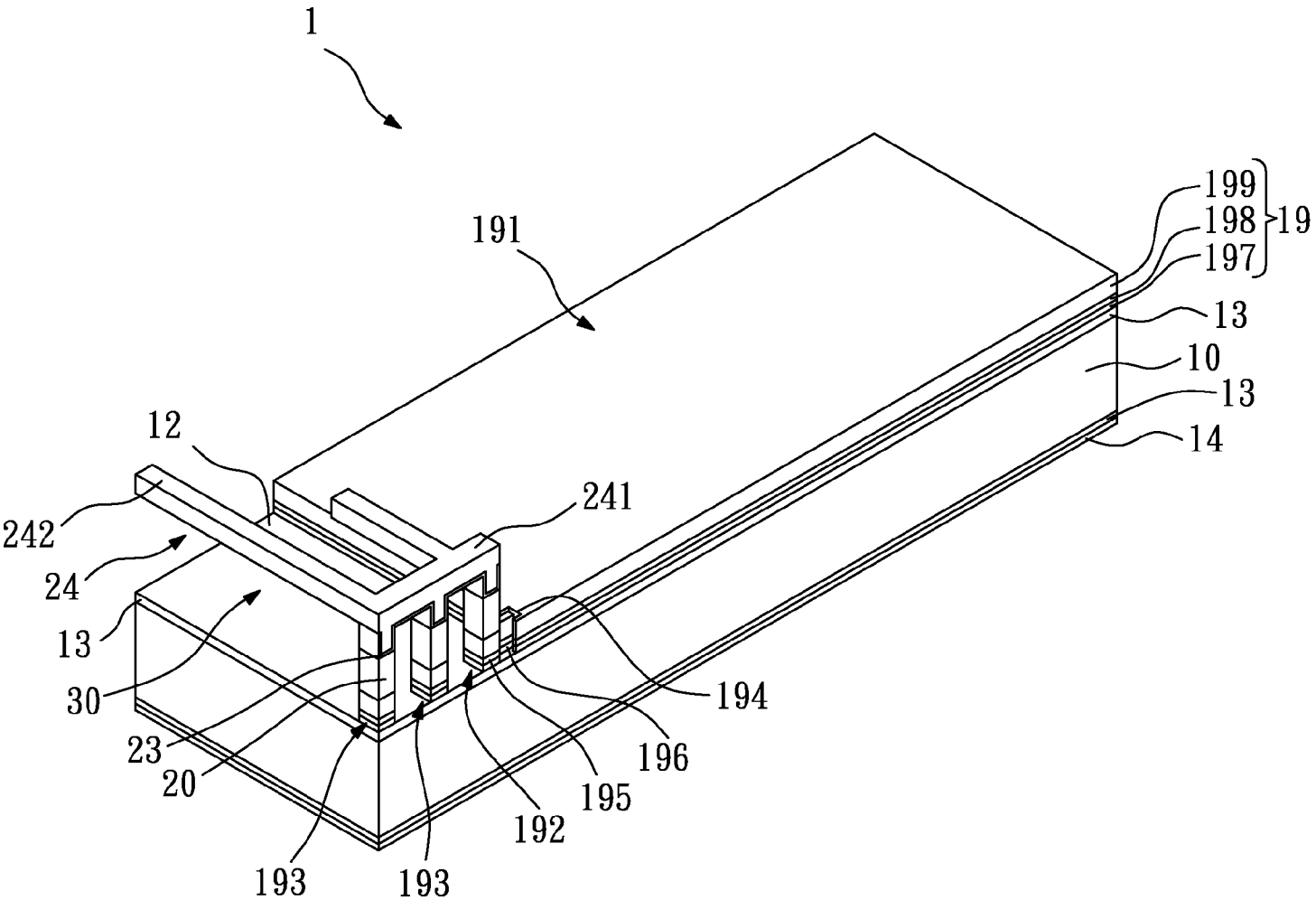

FIG. 8A is a top view of the silicon-based suspending antenna according to one embodiment of the disclosure. FIG. 8B is a cross-sectional view along a cross-sectional line 8B-8B in FIG. 8A. FIG. 9 is a perspective view of the silicon-based suspending antenna according to one embodiment of the disclosure. As shown in FIGS. 2, 7C, 8A, 8B and 9, a plurality of regular recesses 111 are formed on the first side surface 11 according to the first pattern 15. In this embodiment, parts of the nitride layer 14, silicon dioxide layer 13 and silicon substrate 10 are removed so as to form the recesses 111, and the third photoresist mask 21 and the fourth photoresist mask 25 are immersed in acetone solution and removed. It is noted that since the seed layer 23 is extremely thin (less than 1 μm), the partial seed layer 23 out of the fourth pattern 26 is removed along with the third photoresist mask 21 and the fourth photoresist mask 25 (equivalent to lift-off process), and the silicon-based suspending antenna 1 of the disclosure is produced.

As shown in FIGS. 8A, 8B and 9, in the silicon-based suspending antenna 1, the F-shaped structure 24 is disposed on the spacing parts 20, the first base 192 and the second bases 193, so that the F-shaped structure 24 is suspended above the silicon dioxide layer 13 at a distance.

In this embodiment, the recesses 111 are formed by etching with KOH solution. In a cross-sectional view along the cross-sectional direction perpendicular to the first side surface 11, the shape of each recess 111 is trapezoid (as shown in FIG. 8B). The recesses 111 serve as photonic bandgap structures of the silicon-based suspending antenna 1.

FIGS. 8A-8D are top view, cross-sectional view, bottom view and partially-enlarged view of the F-shaped structure of the silicon-based suspending antenna according to one embodiment of the disclosure. The silicon-based suspending antenna 1 has a silicon substrate 10 and a wireless communication unit 30. The silicon substrate 10 has first side surface 11 and second side surface 12, the first side surface 11 having a plurality of regular recesses, and the second side surface 12 having a longitudinal edge 121. In a cross-sectional view along the cross-sectional direction perpendicular to the first side surface 11, the shape of each recess 111 is trapezoid (as shown in FIG. 8B).

In this embodiment, the opening of each recess 111 is square, and each side length r of the opening of each recess 111 is 1.764 to 2.156 mm, preferably 1.96 mm. Each recess 111 has a depth t of 315 to 385 μm, preferably of 350 μm.

To a longitudinal direction of the first side surface 11, every two neighboring recesses 111 has a first interval k therebetween; to a wide direction of the first side surface 11, every two neighboring recesses 111 has a second interval p therebetween. There are a third interval q, a fourth interval s and a fifth interval y between the recesses 111 and two longitudinal edges of the first side surface 111, respectively, and between the recesses 111 and a wide edge of the first side surface 111. In this embodiment, the first interval k is 0.306 to 0.374 mm, preferably 0.34 mm. The second interval p is 0.126 to 0.154 mm, preferably 0.14 mm. The third interval q is 0.306 to 0.374 mm, preferably 0.34 mm. The fourth interval s is 0.45 to 0.55 mm, preferably 0.50 mm. The fifth interval y is 0.54 to 0.66 mm, preferably 0.60 mm.

The wireless communication unit 30 is disposed on the second side surface 12 and includes an electrode layer 19, a spacing part 20 and an F-shaped structure 24. In this embodiment, the electrode layer 19 is a Ground-Signal-Ground (GSG) bottom electrode, and includes a plurality of conductive layers 197, 198, 199 (TaN layer, Ta layer, Cu layer), and the conductive layers 197, 198, 199 preferably have thicknesses of 900-1100 Å, 150-250 Å and 1800-2200 Å, respectively.

In this embodiment, the electrode layer 19 includes a flat part 191, a first base 192 and two second bases 193. The flat part 191 has a notch 194 on one side. The first base 192, the second bases 193 and the notch 194 are separately disposed on the second side surface 12 and essentially parallel to the longitudinal edge 121 of the second side surface 12. The first base 192 has a main body 195 and an extension 196, and the extension 196 extends from the main body 195 and into the notch 194. Two grounding contacts G are disposed on the flat part 191 and at the opposite sides of the notch 194. A coplanar waveguide (CPW) feed-in point S is disposed at the extension 196 (as shown in FIG. 4A)

The flat part 191 preferably has a length m and a width n of 16.2 to 19.8 mm and 6.3 to 7.7 mm, respectively; the extension 196 preferably has a length f and a width e of 0.54 to 0.66 mm and 0.05 to 0.15 mm, respectively. In this embodiment, the flat part 191 has a length m and a width n of 18.0 and 7.0 mm, respectively; the extension 196 has a length f and a width e of 0.6 mm and 0.1 mm, respectively.

Preferably, there is a distance u of 0.09 to 0.11 mm between the notch 194 and the longitudinal edge 121 of the second side surface 12; the notch 194 has a width w and a depth z of 0.18 to 0.30 mm and 0.135 to 0.165 mm, respectively. In this embodiment, there is a distance u of 0.10 mm between the notch 194 and the longitudinal edge 121 of the second side surface 12; the notch 194 has a width w and a depth z of 0.20 mm and 0.15 mm, respectively. Additionally, there is a substantially fixed distance g between the extension 196 and different positions of the notch 194, and the substantially fixed distance g is preferably 0.03 to 0.08 mm. In this embodiment, the substantially fixed distance g is 0.05 mm.

The spacing part 20 is disposed on the main body 195 of the first base 192 and the second base 193 and preferably made of copper. The F-shaped structure 24 has a longitudinal part 241, a first transverse part 242 and a second transverse part 243. The longitudinal part 241 is disposed on the spacing parts 20 through the seed layer 23 (preferably made of copper), so that the F-shaped structure 24 is substantially parallel to the second side surface 12. The F-shaped structure 24 is preferably made of copper.

The F-shaped structure 24 has a thickness, maximum length a and maximum width b preferably of 5.0 to 7.0 μm, 6.3 to 7.7 mm and 3.4 to 3.8 mm, respectively. In this embodiment, the thickness, maximum length a and maximum width b are preferably of 6.0 μm, 7.0 mm and 3.6 mm, respectively. A distance h between the F-shaped structure 24 and the silicon dioxide layer 13 of the silicon substrate 10 is 11.88 to 14.52 μm, preferably 13.2 μm.

The longitudinal part 241 of the F-shaped structure 24 further includes opposite first end 244 and second end 245. The first transverse part 242 is connected to the second end 245, and the second transverse part 243 is connected to the longitudinal part 241 and between the first end 244 the second end 245. The second transverse part 243 preferably has a width d of 0.45 to 0.55 mm; a distance c between the second transverse part 243 and an end surface of the first end 244 is preferably 0.81 to 0.99 mm. In this embodiment, the second transverse part 243 has a width d of 0.50 mm; the distance c is 0.81 to 0.90 mm.

The silicon-based suspending antenna 1 of the disclosure can be applied to 3.1-10.6 GHz in UWB (imaging system, automotive radar system, communications and measurement system). In commercial applications, the silicon-based suspending antenna 1 can serve as a wireless transmission multimedia interface of short range and high speed, for example, for digital data transmission in wireless personal network (WPAN) systems. In addition, the silicon-based suspending antenna 1 of the disclosure has a high bandwidth, high transmission rate, low power consumption, high security, high transmission speed, low interference, precision positioning function and low-cost chip structure.

Figure 10:
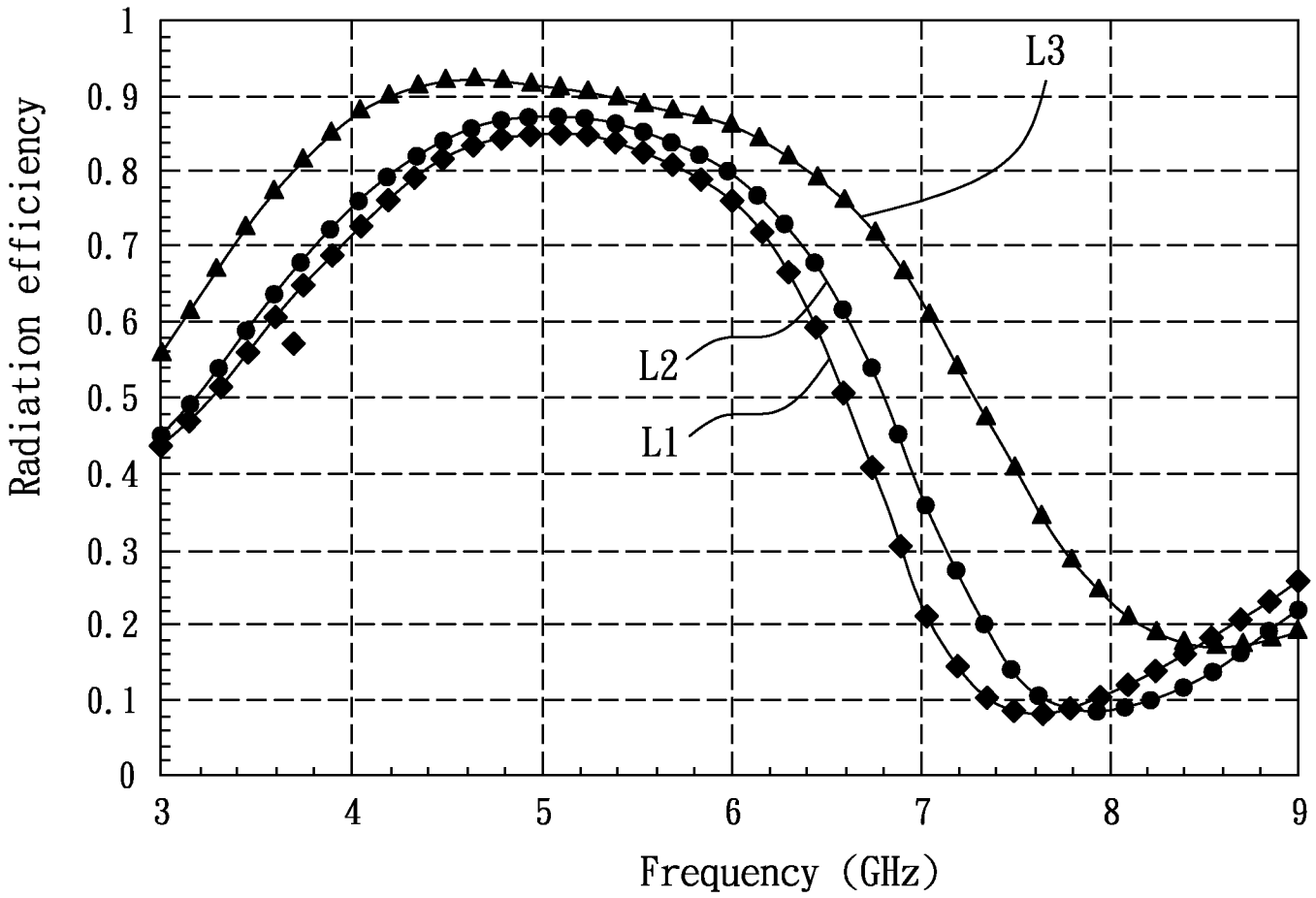
FIG. 10 shows radiation efficiencies of three types of antenna structures.

FIG. 10 shows radiation efficiencies of three types of antenna structures. The three types of antenna structures include a planar antenna without periodic structure (antenna A), a suspending antenna without periodic structure (antenna B) and the silicon-based suspending antenna with periodic structure 1 (antenna C) of the disclosure. Curves L1, L2 and L3 in FIG. 10 indicate radiation efficiencies of antennas A, B and C, respectively. As shown in FIG. 10, the radiation efficiency of antenna C under the resonant frequency of 5.1 GHz is up to 91%, the radiation efficiency of antenna A (under the resonant frequency of 4.9 GHz) is 84%, and the radiation efficiency of antenna B (under the resonant frequency of 5.1 GHz) is 87%. The radiation efficiency of antenna C is higher than those of antennas A and B.

Figure 11:
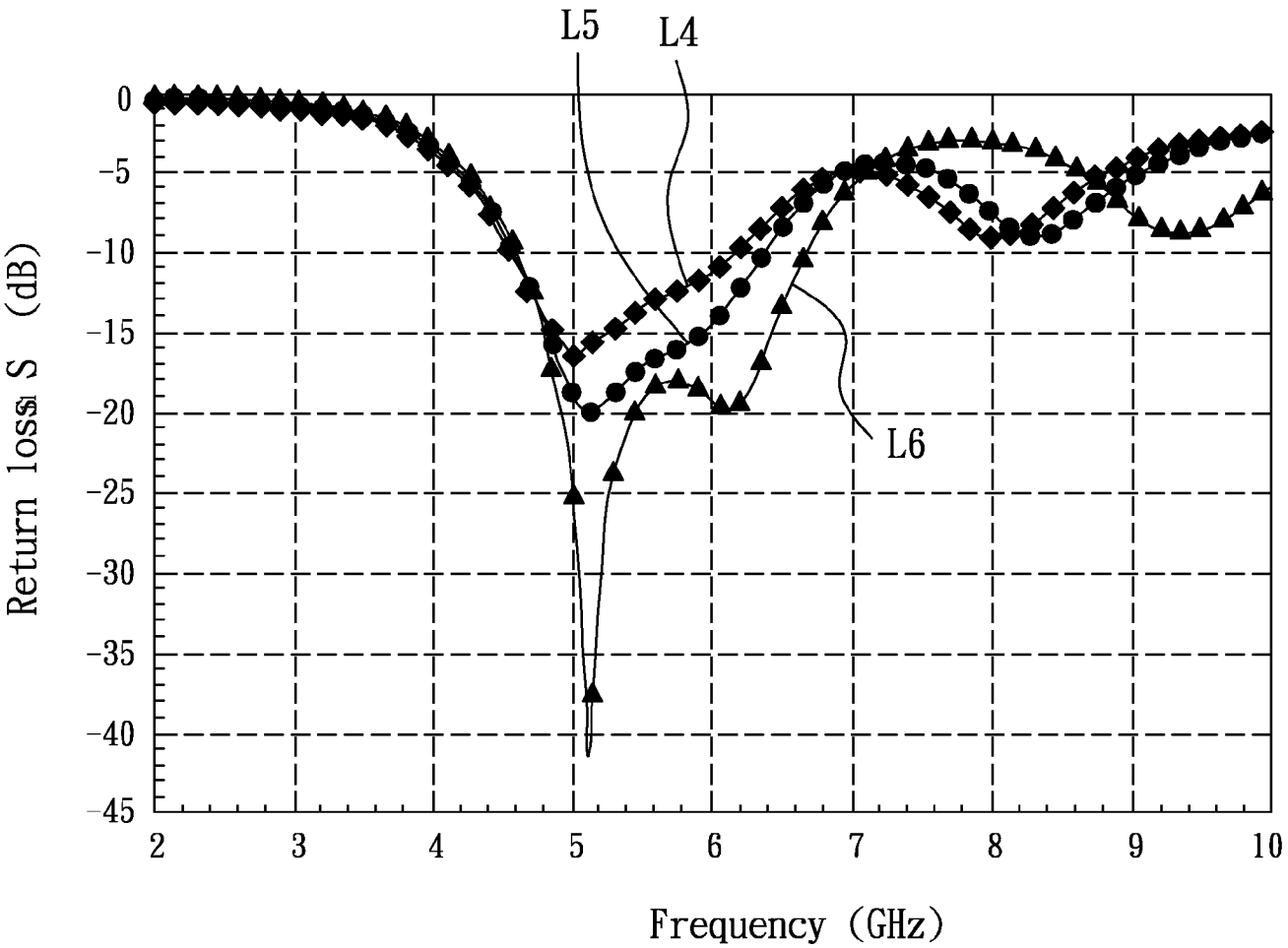
FIG. 11 shows bandwidths and return losses of three types of antenna structures.

FIG. 11 shows bandwidths and return losses (S11) of antennas A, B and C. Curves L4, L5 and L6 in FIG. 11 indicate return losses of antennas A, B and C, respectively. As shown in FIG. 11, the return loss of antenna A is approximately −15.9 dB under the resonant frequency of about 4.9 GHz, and the bandwidth of antenna A is approximately 28% (4.6 GHz~6.1 GHz); the return loss of antenna B is approximately −15.8 dB under the resonant frequency of about 5.1 GHz, and the bandwidth of antenna B is approximately 31% (4.6 GHz~6.3 GHz); and the return loss of antenna C is approximately of −41.6 dB under the resonant frequency of about 5.1 GHz, and the bandwidth of antenna B is approximately 36% (4.6 GHz~6.6 GHz). Therefore, the return loss and bandwidth of antenna C are better than those of antennas A and B.

Figure 12:
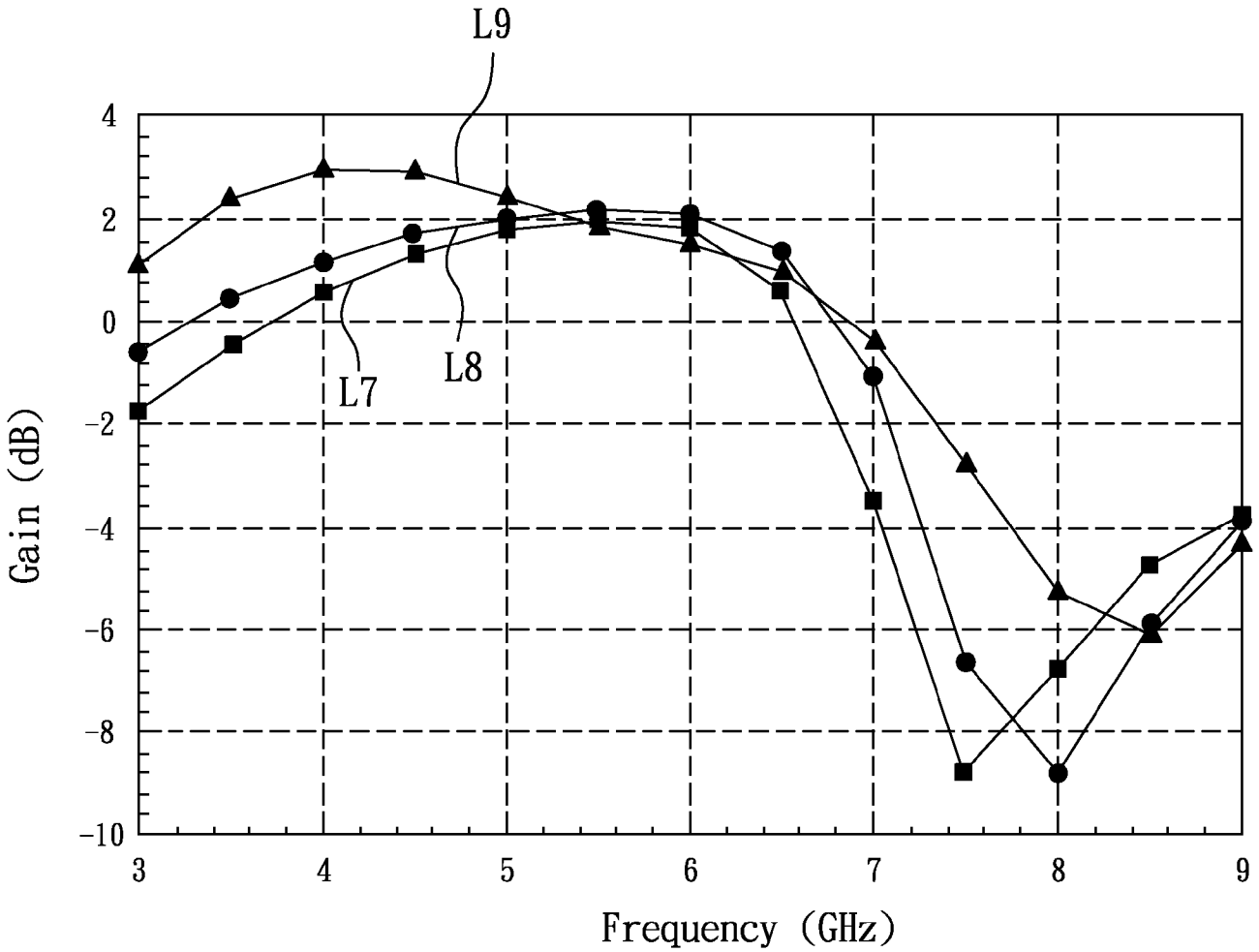
FIG. 12 shows the maximum gains of three types of antenna structures.

FIG. 12 shows the maximum gains of antennas A, B and C. Curves L7, L8 and L9 indicate maximum gains of antennas A, B and C, respectively. As shown in FIG. 12, the maximum gain of antenna A is approximately 1.8 dB under the resonant frequency of about 4.9 GHz; the maximum gain of antenna B is approximately 2.0 dB under the resonant frequency of about 5.1 GHz; and the maximum gain of antenna C is approximately 2.3 dB under the resonant frequency of about 5.1 GHz. Therefore, the maximum gain of antenna C is better than those of antennas A and B.

Figure 13:
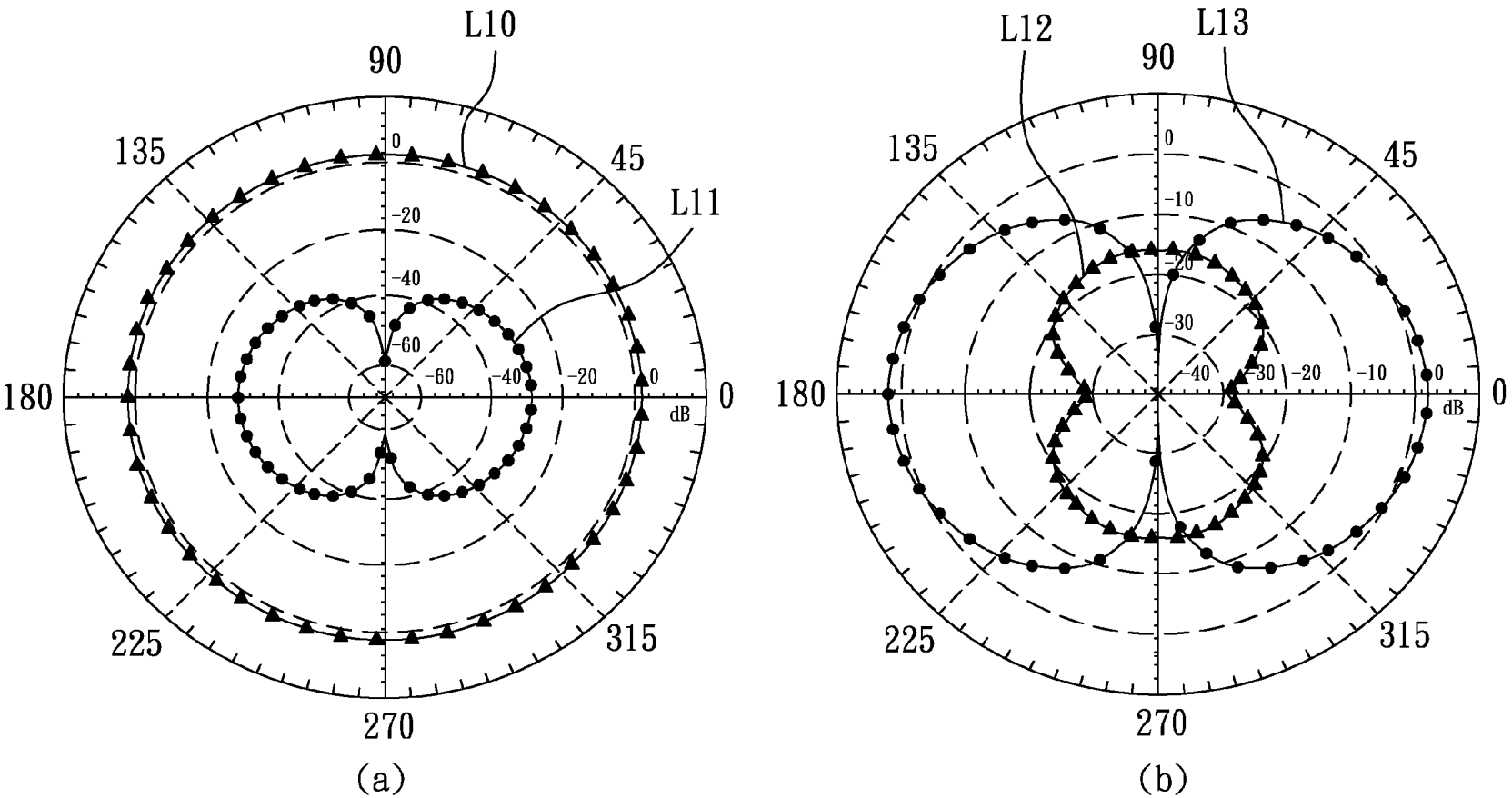
FIGS. 13A and 13B show the directive gain field pattern of the silicon-based suspending antenna according to one embodiment of the disclosure.

FIGS. 13A and 13B show the directive gain field pattern of the silicon-based suspending antenna of the disclosure. FIG. 13A shows the directive gain field pattern in an x-z plane in spherical coordinate, and curves L10 and L11 indicate gains according to angles ψ and θ in spherical coordinate, respectively; and FIG. 13B shows the directive gain field pattern in an y-z plane in spherical coordinate, and curves L12 and L13 indicate gains according to angles ψ and θ in spherical coordinate, respectively. As shown in FIGS. 13A and 13B, the silicon-based suspending antenna 1 of the disclosure has symmetrical gain field pattern both in x-z plane and y-z plane and can serve as an excellent omnidirectional antenna.

The silicon-based suspending antenna with photonic bandgap structure of the disclosure can be manufactured by IC thin film process, surface micromachining and bulk micromachining, to form a plurality of regular recesses on a side surface of a silicon substrate (to serve as a photonic bandgap structure). The silicon-based suspending antenna with photonic bandgap structure of the disclosure has the effects of:

1. through the F-shaped structure increasing the antenna bandwidth and component's radiation efficiency.

2. through the optimal design of the recesses of the silicon substrate (photonic bandgap structure) restraining antenna spurious wave and increasing antenna radiation efficiency and gain.

3. using bulk micromachining etching the silicon substrate to form the regular recesses with a required depth (air layer depth), to reduce the dielectric constant of the silicon substrate, which increases the antenna bandwidth.

While several embodiments of the disclosure have been illustrated and described, various modifications and improvements can be made by those skilled in the art. The embodiments of the disclosure are therefore described in an illustrative but not restrictive sense. It is intended that the disclosure should not be limited to the particular forms as illustrated, and that all modifications which maintain the spirit and scope of the invention are within the scope defined in the appended claims.

What is claimed is:

1. A silicon-based suspending antenna with photonic bandgap structure, comprising:

a silicon substrate, having a first side surface and a second side surface oppositing to the first surface, the first side surface having a plurality of regular recesses for restraining spurious wave of the silicon-based suspending antenna and the second side surface having a longitudinal edge;

an electrode layer, having a flat part, a first base and at least one second base, one side of the flat part having a notch, the first base, the second base and the notch separately being disposed on the second side surface and essentially parallel to the longitudinal edge of the second side surface, the first base having a main body and an extension, and the extension extending from the main body and into the notch, wherein the at least one second base is disposed at a corner of the silicon substrate;

a spacing part, disposed on the second base; and an F-shaped structure, having a longitudinal part disposed on the spacing part and parallel to the second side surface, wherein the spacing part is configured for supporting the longitudinal part and the F-shaped structure is supported by the first base, the at least one second base and the spacing part thereby.

2. The silicon-based suspending antenna with photonic bandgap structure according to claim 1, wherein the opening of each recess is square, and each side length of the opening of each recess is 1.764 to 2.156 mm.

3. The silicon-based suspending antenna with photonic bandgap structure according to claim 1, wherein each recess has a depth of 315 to 385 μm.

4. The silicon-based suspending antenna with photonic bandgap structure according to claim 3, wherein each recess has a depth of 350 μm.

5. The silicon-based suspending antenna with photonic bandgap structure according to claim 1, wherein corresponding to a longitudinal direction of the first side surface, every two neighboring recesses has a first interval therebetween; corresponding to a wide direction of the first side surface, every two neighboring recesses has a second interval therebetween; and there are a third interval, a fourth interval and a fifth interval between the recesses and two longitudinal edges of the first side surface, respectively, and between the recesses and a wide edge of the first side surface.

6. The silicon-based suspending antenna with photonic bandgap structure according to claim 5, wherein the first interval is 0.306 to 0.374 mm, the second interval is 0.126 to 0.154 mm, the third interval is 0.306 to 0.374 mm, the fourth interval is 0.45 to 0.55 mm, and the fifth interval is 0.54 to 0.66 mm.

7. The silicon-based suspending antenna with photonic bandgap structure according to claim 1, wherein the electrode layer is a Ground-Signal-Ground (GSG) bottom electrode, two grounding contacts are disposed on the flat part and at the opposite sides of the notch, and a coplanar waveguide (CPW) feed-in point is disposed at the extension.

8. The silicon-based suspending antenna with photonic bandgap structure according to claim 1, wherein the flat part has a length and a width n of 16.2 to 19.8 mm and 6.3 to 7.7 mm, respectively; the extension has a length and a width of 0.54 to 0.66 mm and 0.05 to 0.15 mm, respectively.

9. The silicon-based suspending antenna with photonic bandgap structure according to claim 7, wherein there is a distance of 0.09 to 0.11 mm between the notch and the longitudinal edge of the second side surface.

10. The silicon-based suspending antenna with photonic bandgap structure according to claim 7, wherein the notch has a width and a depth of 0.18 to 0.30 mm and 0.135 to 0.165 mm, respectively.

11. The silicon-based suspending antenna with photonic bandgap structure according to claim 10, wherein there is a substantially fixed distance of 0.03 to 0.08 mm between the extension and different positions of the notch.

12. The silicon-based suspending antenna with photonic bandgap structure according to claim 7, wherein the electrode layer includes a plurality of conductive layers.

13. The silicon-based suspending antenna with photonic bandgap structure according to claim 12, wherein the electrode layer sequently includes a TaN layer, a Ta layer and a Cu layer, and the TaN layer is disposed on the second side surface.

14. The silicon-based suspending antenna with photonic bandgap structure according to claim 1, wherein there is a distance of 11.88 to 14.52 μm between the F-shaped structure and the silicon substrate.

15. The silicon-based suspending antenna with photonic bandgap structure according to claim 1, wherein the F-shaped structure has a thickness, maximum length and maximum width of 5.0 to 7.0 μm, 6.3 to 7.7 mm and 3.4 to 3.8 mm, respectively.

16. The silicon-based suspending antenna with photonic bandgap structure according to claim 1, wherein the F-shaped structure further comprises a first transverse part and a second transverse part, the first transverse part is connected to a second end of the longitudinal part, and the second transverse part is connected to the longitudinal part and between the first end and the second end.

17. The silicon-based suspending antenna with photonic bandgap structure according to claim 16, wherein the second transverse part has a width of 0.45 to 0.55 mm.

18. The silicon-based suspending antenna with photonic bandgap structure according to claim 16, wherein there is a distance of 0.81 to 0.99 mm between the second transverse part and an end surface of the first end.

19. A method for making a silicon-based suspending antenna with photonic bandgap structure, comprising the steps of:

providing a silicon substrate having a first side surface and a second side surface oppositing to the first surface, wherein the second side surface has a longitudinal edge;

defining a first pattern and a second pattern on the first side surface and the second side surface, respectively;

forming an electrode layer on the second side surface according to the second pattern, wherein the electrode layer has a flat part, a first base and at least one second base, one side of the flat part having a notch, the first base, the second base and the notch separately being disposed on the second side surface and essentially parallel to the longitudinal edge of the second side surface, the first base has a main body and an extension, and the extension extends from the main body and into the notch, wherein the at least one second base is disposed at a corner of the silicon substrate;

forming a spacing part on the second base;

forming an F-shaped structure, wherein the F-shaped structure has a longitudinal part disposed on the spacing part and is parallel to the second side surface, wherein the spacing part is configured for supporting the longitudinal part and the F-shaped structure is supported by the first base, the at least one second base and the spacing part thereby; and forming a plurality of regular recesses on the first side surface according to the first pattern for restraining spurious wave of the silicon-based suspending antenna.

20. The method according to claim 19, wherein a first pattern and a second pattern are defined by using a first photoresist mask and a second photoresist mask, respectively.

21. The method according to claim 20, further comprising the steps of:

forming a plurality of conductive layers according to the second pattern; and removing the second photoresist mask and parts of the conductive layers thereon to form the electrode layer.

22. The method according to claim 21, wherein a TaN layer, a Ta layer and a Cu layer is formed on the second side surface to form the conductive layers.

23. The method according to claim 19, further comprising the steps of:

disposing a third photoresist mask on the second side surface to define a third pattern, wherein the third photoresist mask has two openings located at the relative position above the main body and the second base; and forming a spacing part in the openings by electroplating deposition.

24. The method according to claim 23, further comprising a step of forming a seed layer, wherein the seed layer covers the third photoresist mask and the spacing parts and has two notches correspondingly above the spacing parts.

25. The method according to claim 24, further comprising the steps of:

defining a fourth pattern on the seed layer by using a fourth photoresist mask, wherein the fourth pattern matches the pattern of the F-shaped structure; and forming the F-shaped structure on the seed layer according to the fourth pattern by electroplating deposition.

26. The method according to claim 24, wherein part of the silicon substrate is removed from the first side surface according to the first pattern to form the regular recesses, and the third photoresist mask, the fourth photoresist mask and the partial seed layer out of the fourth pattern are removed.

* * * * *